US011460154B2

(12) United States Patent
Lu et al.

(10) Patent No.: US 11,460,154 B2
(45) Date of Patent: Oct. 4, 2022

(54) HOLELESS ROTARY LAMP CAP

(71) Applicant: Xiamen PVTECH Co., Ltd., Fujian (CN)

(72) Inventors: Fuxing Lu, Fujian (CN); Sishan Liao, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 17/426,632

(22) PCT Filed: Jan. 31, 2019

(86) PCT No.: PCT/CN2019/074229

§ 371 (c)(1),
(2) Date: Jul. 28, 2021

(87) PCT Pub. No.: WO2020/155036

PCT Pub. Date: Aug. 6, 2020

(65) Prior Publication Data

US 2022/0049821 A1 Feb. 17, 2022

(51) Int. Cl.

| | |
|---|---|
| ***F21K 9/272*** | (2016.01) |
| ***F21V 15/015*** | (2006.01) |
| ***F21V 21/30*** | (2006.01) |

(52) U.S. Cl.

CPC ..... *F21K 9/272* (2016.08); *F21V 15/015* (2013.01); *F21V 21/30* (2013.01)

(58) Field of Classification Search

CPC ..... F21K 9/272; F21V 15/015

See application file for complete search history.

(56) References Cited

U.S. PATENT DOCUMENTS

| | | | | |
|---|---|---|---|---|
| 2006/0126325 | A1* | 6/2006 | Lefebvre | F21K 9/272 362/217.05 |
| 2016/0123543 | A1* | 5/2016 | He | F21K 9/65 362/221 |
| 2018/0100626 | A1* | 4/2018 | Minter | F21K 9/272 |
| 2019/0338897 | A1* | 11/2019 | Brown | F21V 23/06 |

FOREIGN PATENT DOCUMENTS

| | | | | |
|---|---|---|---|---|
| CN | 203190340 U | * | 9/2013 | |
| EP | 3032164 A1 | * | 6/2016 | F21V 23/06 |
| EP | 3495727 A1 | * | 6/2019 | H01R 13/2421 |

* cited by examiner

*Primary Examiner* — William N Harris
(74) *Attorney, Agent, or Firm* — Winston Hsu

(57) ABSTRACT

A rotary lamp cap, includes a casing element, a rotary loop, and a side end cover. The casing element and the side end cover are respectively sleeved on a groove at each side of the rotary loop. When the rotary loop moves away from the casing element, the rotary loop and the casing element change from the original buckled state to the disengaged state. An outside end face of the side end cover includes a flat area and two plug-in holes, the flat area is located outside the plug-in holes, and two conductive poles are respectively plugged in the plug-in holes. No other holes except for the plug-in holes are provided on the end face of the side end cover, thereby enabling the side end cover to have locking function with no air hole.

3 Claims, 3 Drawing Sheets

HOLELESS ROTARY LAMP CAP

BACKGROUND OF THE INVENTION

1. Field of the Invention

The present invention relates to a rotatable lamp socket, in particular to a hole-less rotatable lamp socket.

2. Description of the Prior Art

In the field of lighting technology, OLED (organic light emitting diode) has the advantages of self-emissive (self-emissive), wide viewing angle, fast response time, large temperature range, high contrast, low power consumption, and simple process, etc., and therefore in the manufacturing of lighting fixtures, the OLED lights gradually attracted attention; nevertheless, there is still much room for its improvement.

In our daily lives, lighting apparatuses are essential and important tools. In particular, elongated lamps are commonly utilized in homes and businesses, and are quite common. In some lamps, holes are provided on the lamp sockets, some for heat dissipation, and some for structural alignment or layout consideration of the lamps. However, the configuration of the hole makes the manufacturing process of the lamp have a higher cost and also limits the locking function of the lamp socket. Moreover, the configuration of the hole may allow dusts outside the lamp entering into the lamp through the hole or even allow insects flying into the lamp through the hole.

SUMMARY OF THE INVENTION

In view of these issues, in one embodiment, a hole-less rotatable lamp socket comprises a socket member, a rotatable ring body, and a side cap. Recesses at two ends of the rotatable ring body are respectively fitted over the socket member and the side cap. The rotatable ring body is capable of being moved in a direction away from the socket member, so that a state between the rotatable ring body and the socket member is changed from an engaged state to a detached state. An outer end surface of the side cap comprises a flat region and two insertion holes. The flat region is out of the two insertion holes. Two conductive posts are respectively inserted into the two insertion holes. Two outer peripheral side walls extend from the side cap, and an opening is between the two outer peripheral side walls. An inner surface of the side cap corresponding to the opening protrudes an engaging structure. A mold-drawing direction of the side cap is detached from the opening, and is detached outwardly from the inner surface of the side cap.

In one or some preferable implementations of the hole-less rotatable lamp socket, the socket member further comprises a first rotatable structure at a first end of the socket member, and the first rotatable structure comprises a protruding post and a positioning block outside the protruding post.

In one or some preferable implementations of the hole-less rotatable lamp socket, an inner wall of the rotatable ring body comprises a positioning structure for limiting the first rotatable structure, and the positioning structure comprises a through hole engaged with the protruding post.

In one or some preferable implementations of the hole-less rotatable lamp socket, the side cap further comprises a second rotatable structure engaged with the first rotatable structure.

In one or some preferable implementations of the hole-less rotatable lamp socket, a side wall extends from the side cap, the positioning structure has an engaging groove formed at the inner wall of the rotatable ring body, and the side wall is engaged with the engaging groove.

In one or some preferable implementations of the hole-less rotatable lamp socket, an outer peripheral surface of the rotatable the rotatable ring body comprises a plurality of indents, an outer peripheral portion protrudes from the socket member and protruding spots are on the outer peripheral portion, and the indents are aligned with the protruding spots.

Based on the above, in the rotatable lamp socket and the lamp having thereof according to one or some embodiments, in the manufacturing process, the side cap has a different mold-drawing direction as compared with the known lamp sockets. Moreover, the end surface of the side cap merely has the insertion holes and does not have other holes. In other words, the side cap does not have ventilation holes and provides the locking function. Furthermore, the rotatable lamp socket can not only have the dustproof function but also can prevent insects from flying into the lamp, thus ensuring the lamp to provide complete functions. Therefore, the issues occurred in the known lamp devices can be solved.

These and other objectives of the present invention will no doubt become obvious to those of ordinary skill in the art after reading the following detailed description of the preferred embodiment that is illustrated in the various figures and drawings.

DETAILED DESCRIPTION

The detailed description of the technical contents, structural features, and the objects and effects of the technical solutions will be described in detail below with reference to the specific embodiments and the accompanying drawings.

Figure 1:
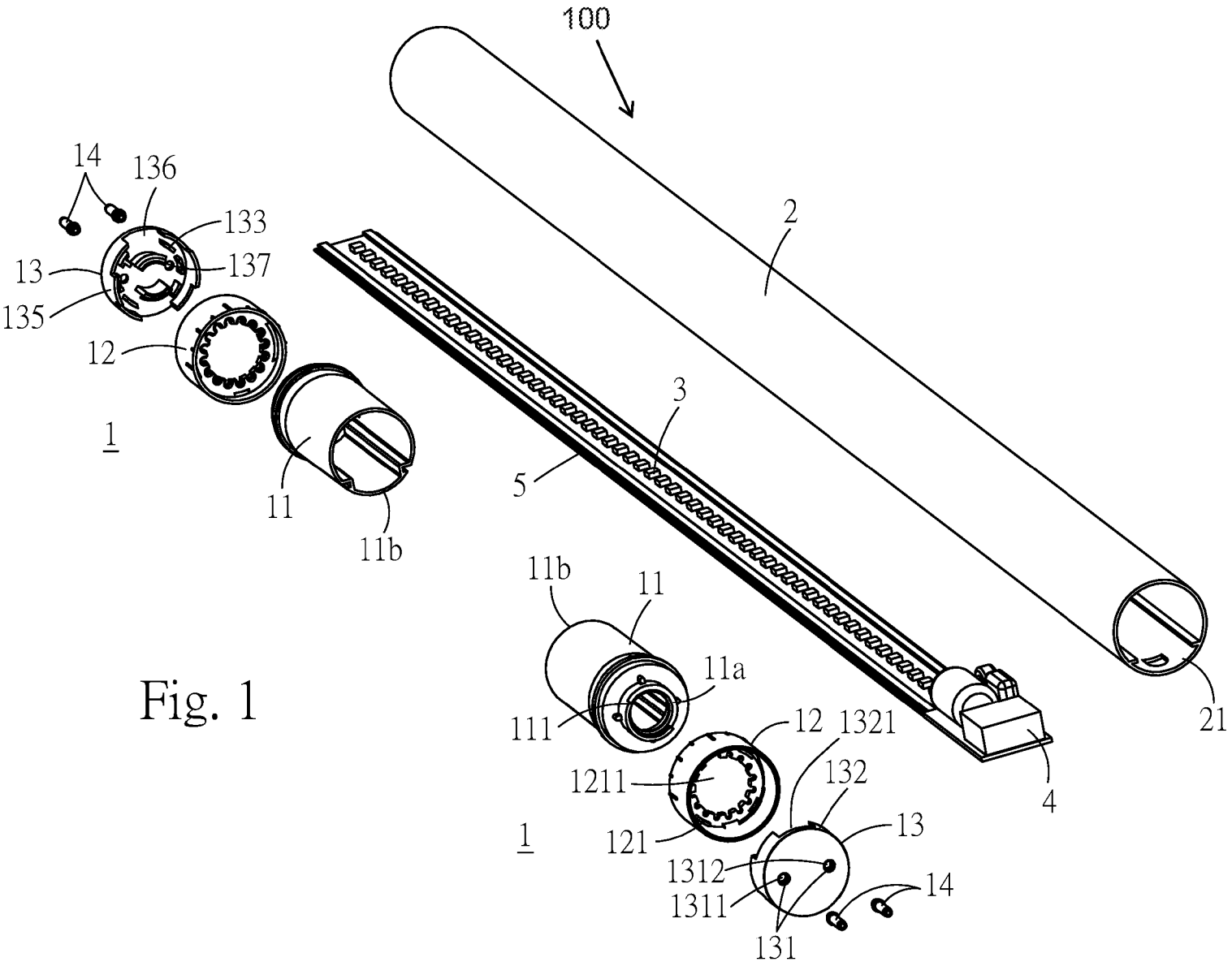
FIG. 1 illustrates an exploded view of a lamp according to an exemplary embodiment of the present invention.
Figure 2:
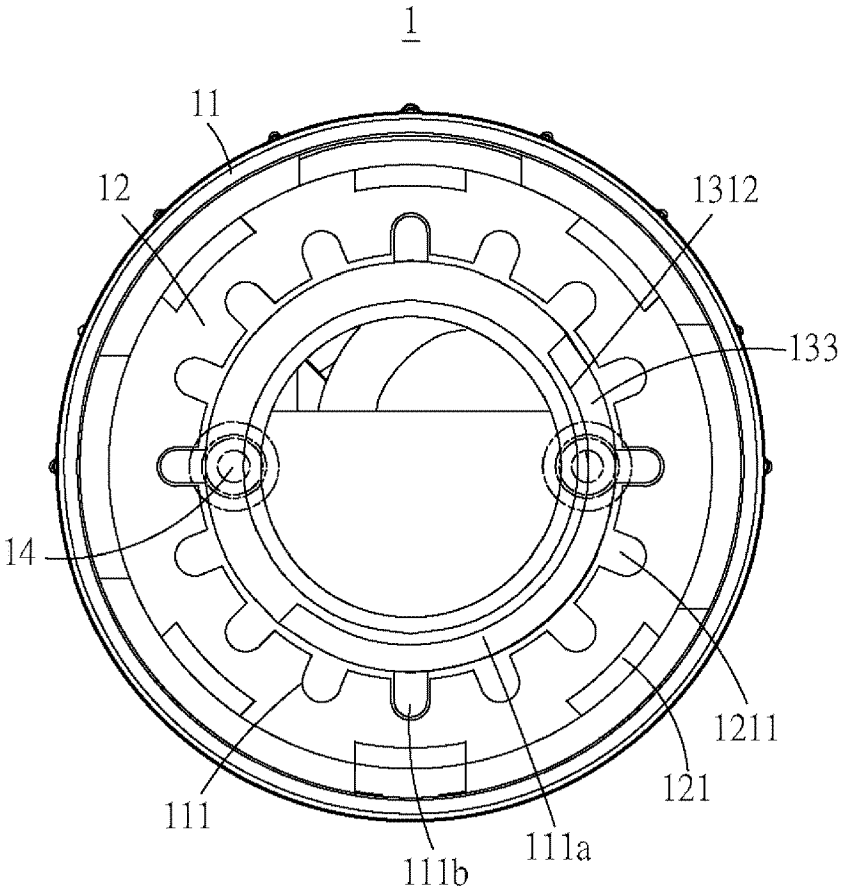
FIG. 2 illustrates a schematic operational view (1) of a rotatable lamp socket according to an exemplary embodiment of the present invention.
Figure 3:
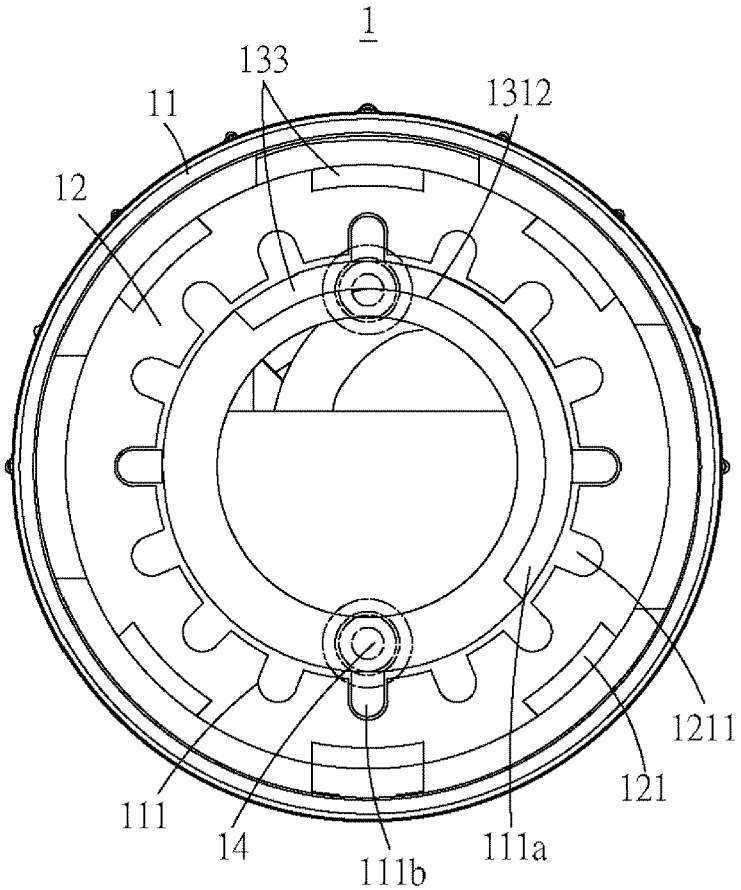
FIG. 3 illustrates a schematic operational view (2) of the rotatable lamp socket according to the exemplary embodiment of the present invention.
Figure 4:
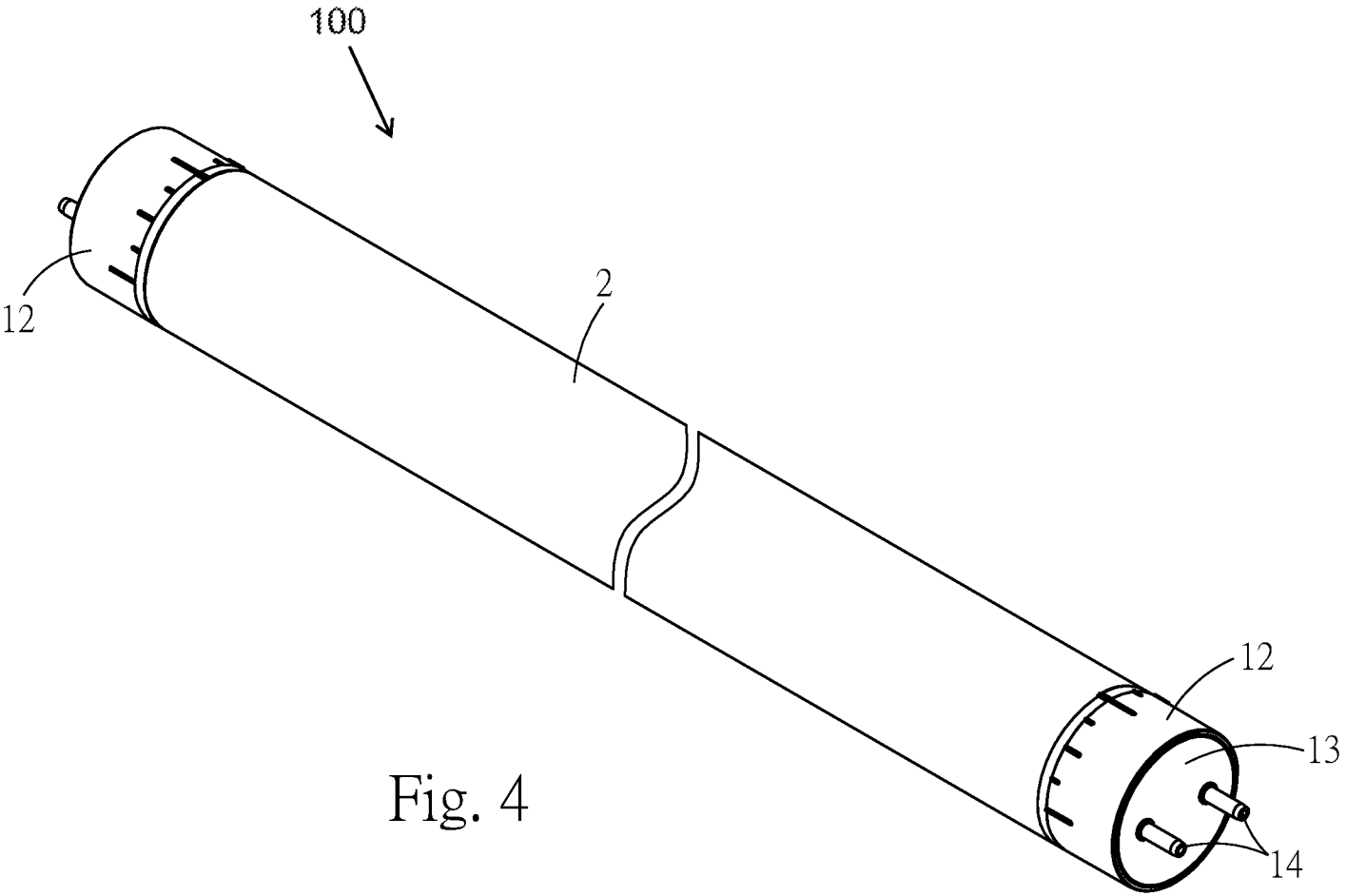
FIG. 4 illustrates an assembled view of a lamp according to an exemplary embodiment of the present invention.

Please refer to FIGS. 1 to 4. FIG. 1 illustrates an exploded view of a lamp according to an exemplary embodiment of the present invention. FIG. 2 illustrates a schematic operational view (1) of a rotatable lamp socket according to an exemplary embodiment of the present invention. FIG. 3 illustrates a schematic operational view (2) of the rotatable lamp socket according to the exemplary embodiment of the present invention. FIG. 4 illustrates an assembled view of a lamp according to an exemplary embodiment of the present invention. In this embodiment, the rotatable lamp socket 1 comprises a socket member 11, a rotatable ring body 12, and a side cap 13.

In this embodiment, the socket member 11 is a hollowed cylinder. The socket member 11 comprises a first end 11*a* in communication therewith and a second end 11*b* opposite to the first end 11*a*.

In this embodiment, the rotatable ring body 12 is a hollowed cylinder. The rotatable ring body 12 is fitted over the first end 11*a* of the socket member 11. The length of the rotatable ring body 12 is less than the length of the socket member 11.

In this embodiment, the side cap 13 is of a round dish shape. The side cap 13 is fitted over the rotatable ring body 12 and is assembled with socket member 11. The side cap 13 comprises an end surface 131 and a tube wall 132. The end surface 131 is connected to the tube wall 132. The tube wall 132 comprises a tube opening 1321, and the tube opening 1321 faces the first end 11*a*. The end surface 131 comprises a flat region 1311 and two insertion holes 1312, and the flat region 1311 is out of the two insertion holes 1312.

In this embodiment, two conductive posts 14 are respectively inserted into the insertion holes 1312, and the conductive post 14 is a copper post.

In these embodiments, two ends of the rotatable ring body 12 form recesses, and the recesses are respectively fitted over the socket member 11 and the side cap 13. When the rotatable ring body 12 is moved in a direction away from the socket member 11, the state between the rotatable ring body 12 and the socket member 11 is changed from an engaged state to a detached state.

In this embodiment, the end surface 131 only has the insertion holes 1312, and the flat region 1311 does not have other holes. Accordingly, two outer peripheral side walls 135 extend from the side cap 13, an opening 136 is between the two outer peripheral side walls 135, and an inner surface of the side cap 13 corresponding to the opening 136 protrudes an engaging structure 137. Therefore, in the manufacturing process, the side cap 13 has a different mold-drawing direction as compared with the known lamp sockets. The mold-drawing direction of the side cap 13 is changed. The mold-drawing direction of the side cap 13 is detached from the opening 136, and is detached outwardly from the inner surface of the side cap 13. The side cap 13 does not have ventilation holes and provides the locking function. Furthermore, the rotatable lamp socket cannot only have the dustproof function but also can prevent insects from flying into the lamp 100, which will damage the conductivity function of the lamp 100 applied with the lamp socket.

In this embodiment, the socket member 11 further comprises a first rotatable structure 111 at the first end 11*a*. An inner wall of the rotatable ring body 12 comprises a positioning structure 121 for limiting the first rotatable structure 111. The side cap 13 further comprises a second rotatable structure 133 engaged with the first rotatable structure 111.

In this embodiment, the first rotatable structure 111 comprises a protruding post 111*a* having a spiral structure. Positioning blocks 111*b* are outside the protruding post 111*a*. The positioning structure 121 comprises a through hole 1211, and the through hole 1211 is gear shaped. Accordingly, by the rotational engagement of the positioning blocks 111*b*, the first rotatable structure 111 can be limited.

In this embodiment, the second rotatable structure 133 corresponds to the first rotatable structure 111, and the second rotatable structure 133 has another engaging structure for being engaged with the first rotatable structure 111 (protruding post) by the rotational engagement. However, the present invention is not limited thereto.

In this embodiment, an outer peripheral side wall extends from the side cap 13, and the positioning structure 121 has an engaging groove formed at the inner wall of the rotatable ring body 12. The outer peripheral side wall is engaged with the engaging groove. When the rotatable ring body 12 is moved in the direction away from the socket member 11, the side cap 13 is moved along with the rotatable ring body 12.

In this embodiment, an outer peripheral surface of the rotatable ring body 12 comprises a plurality of indents space apart from each other, and the indents form long bars and short bars. An outer peripheral portion protrudes from the socket member 11 and protruding spots are on the outer peripheral portion. The long bars are aligned with the protruding spots to ensure that the positioning blocks 111*b* are engaged with the through hole 1211.

In this embodiment, when the lamp socket is applied to a lamp 100 for lighting, the lamp 100 comprises two foregoing rotatable lamp sockets 1 and a light tube 2. Two ends of the light tube 2 are respectively fitted over the rotatable lamp sockets 1. The light tube has two end openings 21, and the rotatable lamp sockets 1 respectively cover the end openings 21. The two side caps 13 respectively at outsides of the two ends of the lamp 100.

In this embodiment, the lamp 100 further comprises a light source plate 3 disposed in the light tube 2.

In this embodiment, the lamp 100 further comprises a power supply 4 disposed in the light tube 2, and the power supply 4 is electrically connected to the light source plate 3 and the conductive posts 14, respectively.

In this embodiment, the lamp 100 further comprises a heat dissipation plate 5 disposed in the light tube 2 for loading the light source plate 3. In some embodiments, the heat dissipation plate 5 is a plate made of aluminum.

Based on the above, in the rotatable lamp socket and the lamp having thereof according to one or some embodiments, in the manufacturing process, the side cap has a different mold-drawing direction as compared with the known lamp sockets. Moreover, the end surface of the side cap merely has the insertion holes and does not have other holes. In other words, the side cap does not have ventilation holes and provides the locking function. Furthermore, the rotatable lamp socket can not only have the dustproof function but also can prevent insects from flying into the lamp, thus ensuring the lamp to provide complete functions. Therefore, the issues occurred in the known lamp devices can be solved.

Although particular embodiments of the invention have been described in detail for purposes of illustration, various modifications and enhancements may be made without departing from the spirit and scope of the invention. Accordingly, the invention is not to be limited except as by the appended claims.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A hole-less rotatable lamp socket, comprising: a socket member, a rotatable ring body, and a side cap, wherein recesses at two ends of the rotatable ring body are respectively fitted over the socket member and the side cap, wherein the rotatable ring body is capable of being moved in a direction away from the socket member, so that a state between the rotatable ring body and the socket member is changed from an engaged state to a detached state, wherein an outer end surface of the side cap comprises a flat region and two insertion holes, the flat region is out of the two insertion holes, two conductive posts are respectively inserted into the two insertion holes, two outer peripheral side walls extend from the side cap, and an opening is between the two outer peripheral side walls, an engaging structure protrudes from an inner surface of the side cap corresponding to the opening, and the side cap is able to be drawn in a mold-drawing direction of the side cap to be detached from the rotatable ring body at the opening, and then be detached outwardly from the rotatable ring body at the inner surface of the side cap, wherein the socket member further comprises a first rotatable structure at a first end of the socket member, and the first rotatable structure comprises a protruding post and positioning blocks outside the protruding post, wherein an inner wall of the rotatable ring body comprises a positioning structure for limiting the first rotatable structure, and the positioning structure comprises a through hole engaged with the protruding post, wherein the side cap further comprises a second rotatable structure engaged with the first rotatable structure, wherein the second rotatable structure is disposed on the inner surface of the side cap and adjacent to the engaging structure.

2. The hole-less rotatable lamp socket according to claim 1, wherein a side wall extends from the side cap, the positioning structure has an engaging groove formed at the inner wall of the rotatable ring body, and the side wall is engaged with the engaging groove.

3. The hole-less rotatable lamp socket according to claim 1, wherein an outer peripheral surface of the rotatable the rotatable ring body comprises a plurality of indents, an outer peripheral portion protrudes from the socket member and protruding spots are on the outer peripheral portion, and the indents are aligned with the protruding spots.

* * * * *